US006666655B2

(12) United States Patent
Heath et al.

(10) Patent No.: US 6,666,655 B2
(45) Date of Patent: Dec. 23, 2003

(54) HYDRAULIC PUMP NOZZLE AND METHOD OF USE

(75) Inventors: Roy William Heath, Midland, MI (US); Douglas D. McClain, Essexville, MI (US); Thomas C. Rytlewski, Auburn, MI (US); Rick L. Lincoln, Linwood, MI (US)

(73) Assignee: Delphi Technologies, Inc., Troy, MI (US)

( * ) Notice: Subject to any disclaimer, the term of this patent is extended or adjusted under 35 U.S.C. 154(b) by 7 days.

(21) Appl. No.: 10/126,595

(22) Filed: Apr. 19, 2002

(65) Prior Publication Data

US 2002/0168269 A1 Nov. 14, 2002

Related U.S. Application Data

(60) Provisional application No. 60/290,630, filed on May 11, 2001.

(51) Int. Cl.[7] ..... F04B 23/08

(52) U.S. Cl. ..... 417/87; 417/53; 60/464; 60/468

(58) Field of Search ..... 417/87, 53, 279; 60/464, 468, 452, 453, 487, 488, 327

(56) References Cited

U.S. PATENT DOCUMENTS 4,663,936 A * 5/1987 Morgan ..... 60/422
4,779,417 A * 10/1988 Kita ..... 60/430
4,838,024 A * 6/1989 Yamamoto et al. ..... 60/488
4,972,675 A * 11/1990 Kawahara et al. ..... 60/488
5,048,295 A * 9/1991 Hoscheler ..... 60/461
6,390,783 B1 * 5/2002 Wong et al. ..... 417/53

FOREIGN PATENT DOCUMENTS

JP 0 942 202 A2 * 9/1999

* cited by examiner

*Primary Examiner*—Justine R. Yu
*Assistant Examiner*—Han L Liu
(74) *Attorney, Agent, or Firm*—Michael D. Smith

(57) ABSTRACT

A hydraulic flow return system of a transmission pump in which primary and bypass flows of hydraulic fluid are returned to primary and bypass flow channels, respectively, of a booster nozzle situated adjacent the rotating group at the inlet of the pump for delivery a boosted flow of high pressure fluid to the pump as a result of the incoming bypass flow being passed through a flow restrictor before being recombined with the primary flow, the system is improved by incorporating a bypass valve which senses the back pressure in the incoming bypass flow and operates to open an auxiliary bypass channel in the event that the back pressure exceeds a predetermined control value in order to divert a fraction of the bypass flow around the flow restrictor for delivery to the pump until such time as the back pressure falls below the control value.

21 Claims, 4 Drawing Sheets

HYDRAULIC PUMP NOZZLE AND METHOD OF USE

The disclosure incorporates the hydraulic pump nozzle and method of use disclosed in provisional application 60/290,630, filed May 11, 2001, whose priority is claimed for this application.

BACKGROUND OF THE INVENTION

1. Technical Field

This invention relates generally to hydraulic pump nozzles employed to boost the fluid flow and pressure of hydraulic fluid delivered to a hydraulic pump rotating group, such as a hydraulic pump of a vehicle transmission system.

2. Related Art

In a typical automotive hydraulic transmission system, a motor driven pump delivered hydraulic fluid under pressure to the transmission to operate the transmission with the return fluid being fed to the pump in a closed system. A prior hydraulic booster nozzle such as that illustrated at 10 in FIG. 1 is situated at the intake of the pump 11 and receives a primary flow 12 of hydraulic fluid returned from a sump of the transmission into a primary flow channel 13 of the nozzle 10. In this system, a fraction of the high pressure flow delivered by the pump is diverted around the transmission and fed back to the pump as a bypass flow 14 into a bypass channel 15 of the nozzle 10. This relatively high velocity, high pressure bypass flow 14 is fed through a restriction 16, causing the fluid velocity to increase and the pressure to decrease at the restriction. The high velocity bypass stream exits the restriction and becomes a lower velocity, higher pressure flow at the intake of the rotating group of the pump 11 where it recombines with the primary flow 12, resulting in an overall increased flow in pressure of the combined fluid flow 17 to the pump 11.

While hydraulic boost nozzles of the type shown in FIG. 1 perform satisfactorily in boosting the pressure and flow of hydraulic fluid to the intake rotating group of the pump, there is a tendency to build unacceptably high levels of back pressure in the bypass flow line which cannot be tolerated by other parts of the flow system, particularly under heavy loading of the transmission and pump which are the typical cause of the excessive back pressure in the bypass line. Consequently, one designed constraint of current booster nozzles is that the flow constraint and other design characteristics of the flow channels must be such that they produce exceptionably low levels of back pressure in the bypass line under heavy loading of the pump within design limits of the other components of the system. However, designing the nozzle to decrease the back pressure in the bypass line has the effect of decreasing the boosting performance of the nozzle for delivering maximum flow of hydraulic fluid to the rotating group at the intake of the pump.

A booster nozzle constructed according to the present invention overcomes or greatly minimizes the foregoing limitations of prior booster nozzle constructions.

SUMMARY OF THE INVENTION AND ADVANTAGES

This invention provides a unique apparatus and method for boosting the pressure at the intake of a hydraulic pump, such as a transmission pump of a vehicle. The apparatus and method are particularly suitable for use in continuously variable transmission (CVT) pump applications. They provide reduced back pressure as compared to prior art booster nozzles, while at the same time providing increased fluid flow, and thus pressure, at the intake of the rotating group. This in turn results in improved pump operating performance, such as reduced cavitation and reduced pump noise at high speeds.

According to particularly preferred features of the invention, the apparatus comprises a nozzle body having a primary flow channel for receiving and delivering a primary flow of hydraulic fluid to the pump. The primary flow is fed from a sump and comprises that portion of the return flow necessary to drive the pump rotating group. The nozzle body is formed with a bypass flow channel that receives a bypass flow of hydraulic fluid from the pump. The bypass flows separately from the primary flow upline of the transmission using an appropriate means, such as splitting the return flow using a bifurcated return line leading from an appropriate flow diverter mechanism situated upstream of the transmission, directing the bypass flow to the bypass flow channel of the nozzle body. The bypass flow is restricted through a restriction device within the bypass flow channel, causing the bypass flow velocity to increase and the pressure to decrease at the restriction. The bypass flow exiting the restriction is recombined with the primary flow in close proximity to the intake of the pump rotating group. As the bypass flow exits the restriction, its flow of velocity decreases producing a corresponding increase in pressure at the intake of the pump rotating group, yielding an overall boost in pressure and flow of the combined primary and bypass flows to the pump.

According to a characterizing feature of the invention, a bypass valve communicates with the bypass channel of the nozzle body. This bypass valve is operated to sense the back pressure in the incoming bypass flow. In response to the back pressure exceeding a predetermined control pressure, the bypass valve opens an auxiliary bypass flow channel and diverts a fraction of the incoming bypass flow around the flow restriction device for direct combination with the delivery of the primary flow to the inlet of the pump. By incorporating a bypass valve into the flow system, a booster nozzle can be designed to optimize its boosting performance to the pump without concern for the effects that such optimized boosting performance would have on the back pressure of the incoming bypass line. The bypass valve can be set to relieve the buildup of back pressure at the appropriate control pressure so as to direct a fraction of the bypass flow around the flow restriction so as to maintain the optimum performance of the booster nozzle for delivery of flow to the pump rotating group, while maintaining the back pressure of the bypass flow below the upper threshold limit control pressure of the particular system.

Another advantage of the present invention is that for a given application, a booster nozzle can be provided with increased boosting performance over that of currently available booster nozzles that at the same time maintains the back pressure of the bypass flow within acceptable design limits. In this way, the boosting performance of the booster nozzle does not need to be sacrificed in order to maintain the back pressure of the bypass flow below design limits.

Another advantage of the present invention is that the same basic booster nozzle construction can be used for a number of difference applications having different bypass flow back pressure requirements, by simply replacing, altering or adjusting the bypass valve to set the control pressure of the valve at the appropriate level to maintain the back pressure below the design limit of the particular application. No longer is it necessary to tailor the flow characteristics of each nozzle body to meet the design criteria of each application, particularly with regard to the limitation set by the bypass back pressure.

Another advantage of the present invention is that the bypass valve can work in conjunction with virtually any combination of primary and bypass flow channel and flow restrictor constructions, and thus is insensitive to the particular design of the booster characteristics of the nozzle. Whatever the design, the bypass valve operates to relieve the back pressure by diverting a fraction of the bypass flow around the flow restrictor. Accordingly, the invention has the further advantage of enabling the same basic bypass valve to be utilized in conjunction with various primary and bypass flow channel configurations. It will thus be appreciated that the subject apparatus has built-in flexibility to meet the design criteria of virtually any flow system calling for a booster nozzle at the intake of a pump in order that the performance of the booster nozzle be optimized both in regard to the delivery of boosted flow to the pump and minimal impact to the performance of the remaining components of the flow system through control of the bypass flow back pressure.

THE DRAWINGS

Presently preferred embodiments of the invention are disclosed in the following description and in the accompanying drawings, wherein.

DETAILED DESCRIPTION

Figure 1:
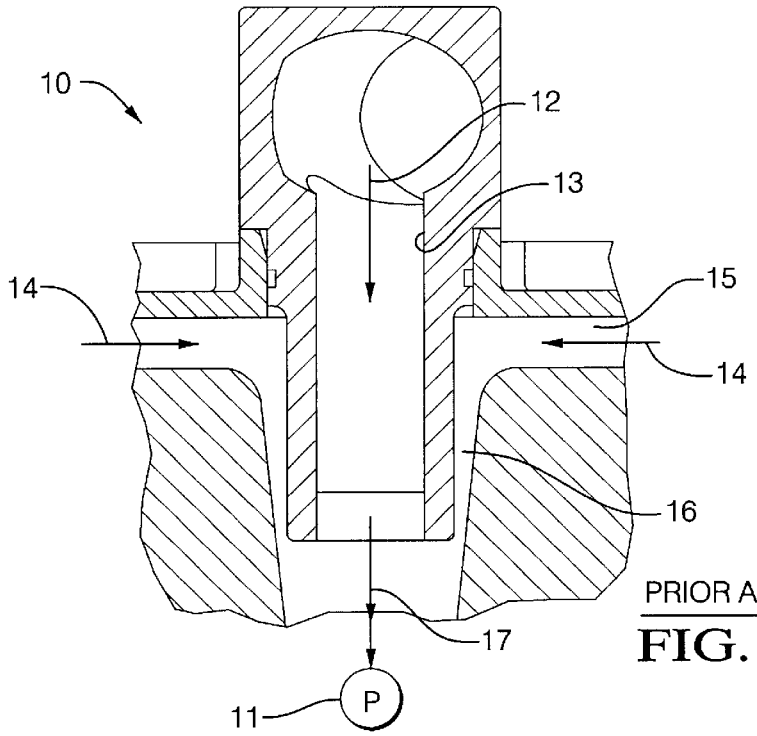
PRIOR ART FIG. 1
FIG. 1 is a prior art booster nozzle.
Figure 2:
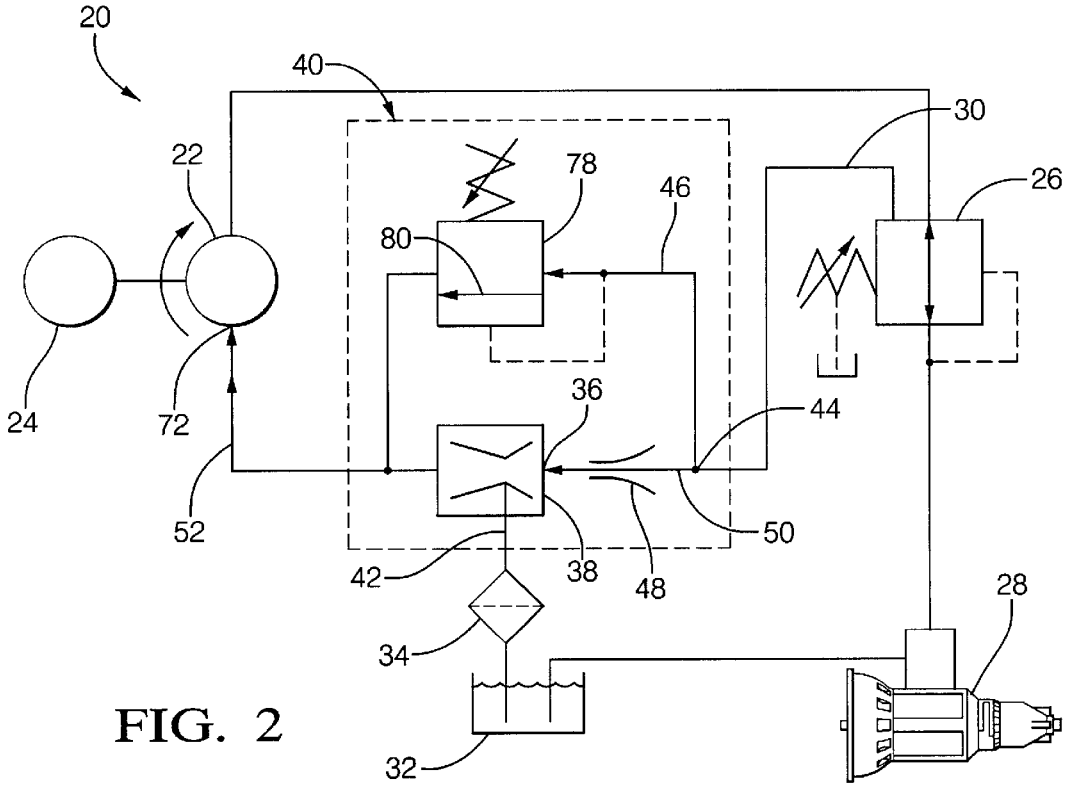
FIG. 2 is a schematic of a hydraulic flow system of the invention.
Figure 3:
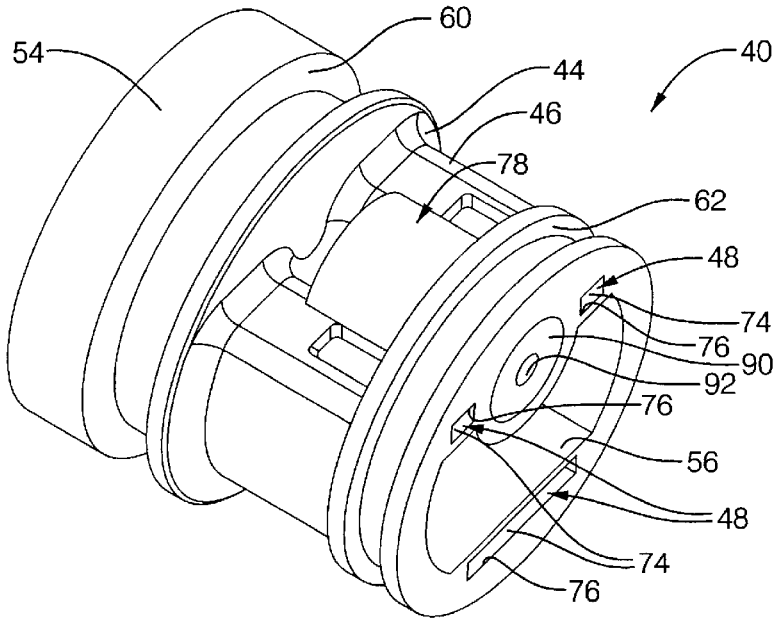
FIG. 3 is a perspective view of a booster nozzle constructed according to a presently preferred embodiment of the invention.
Figure 4:
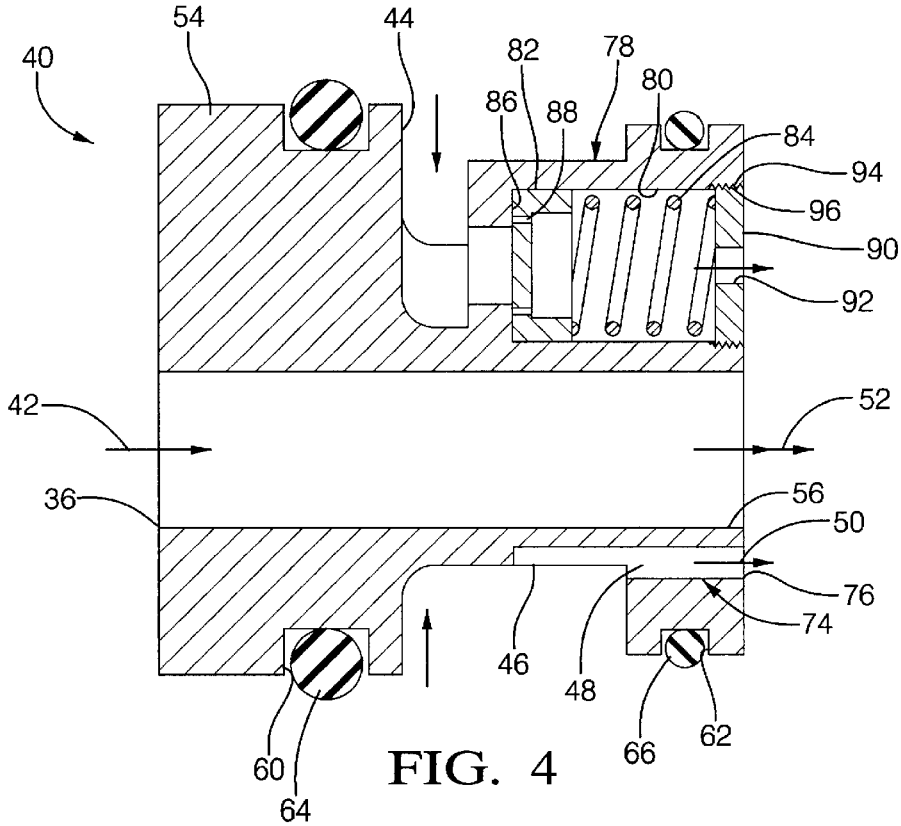
FIG. 4 is an enlarged cross-sectional view of the booster nozzle.
Figure 5:
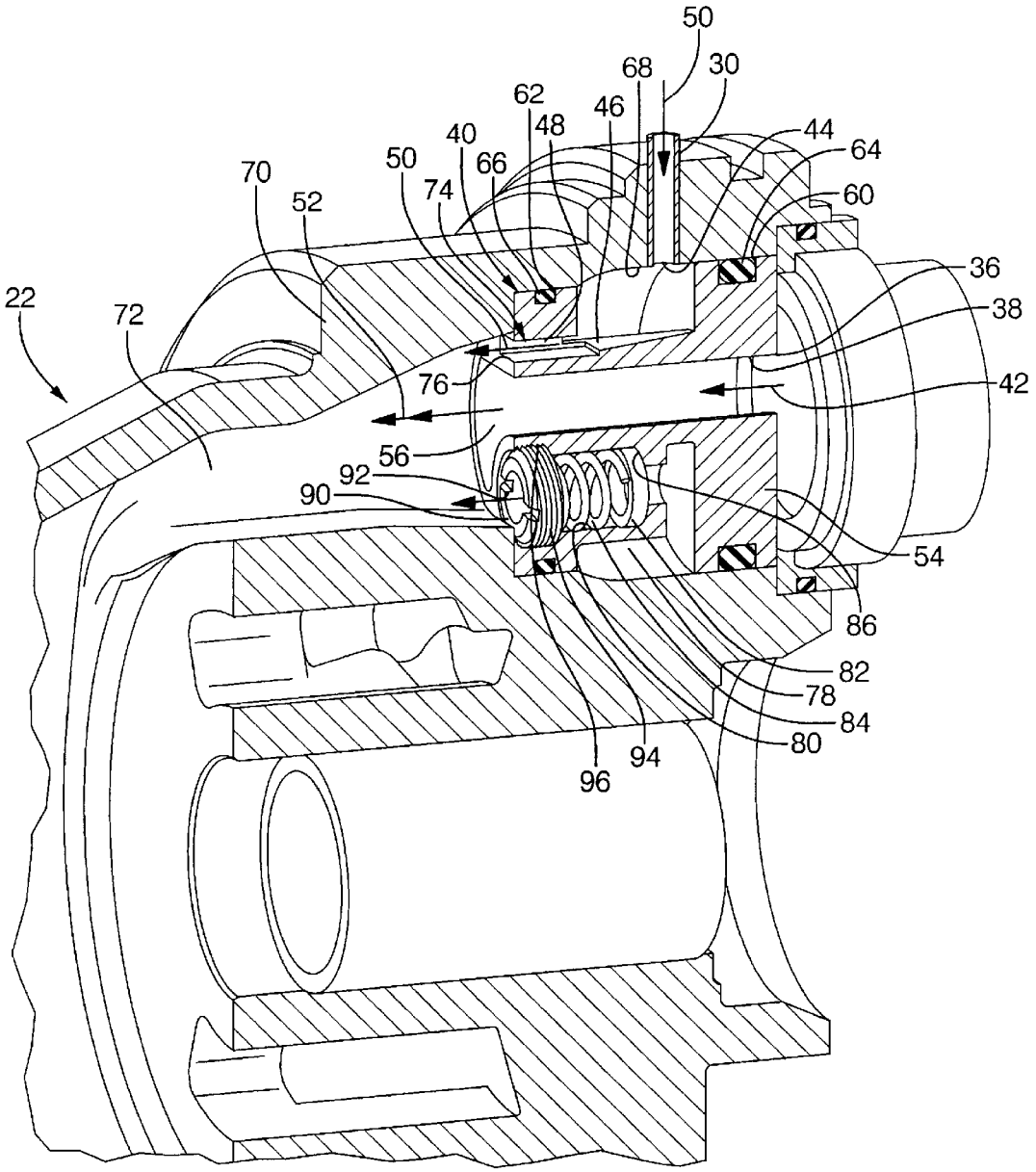
FIG. 5 is a cross-sectional view of the booster nozzle shown associated with an intake of a pump.
Figure 6:
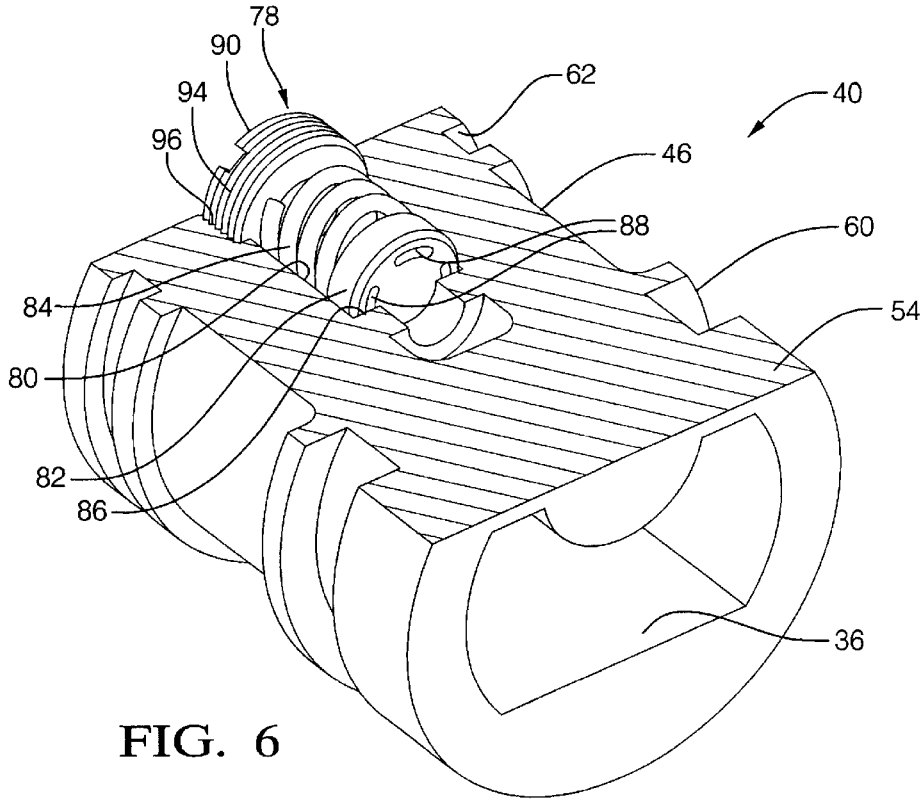
FIGS. 6 and 7 are perspective views of the booster nozzle shown partly in section to illustrate further features of the nozzle body.
Figure 7:
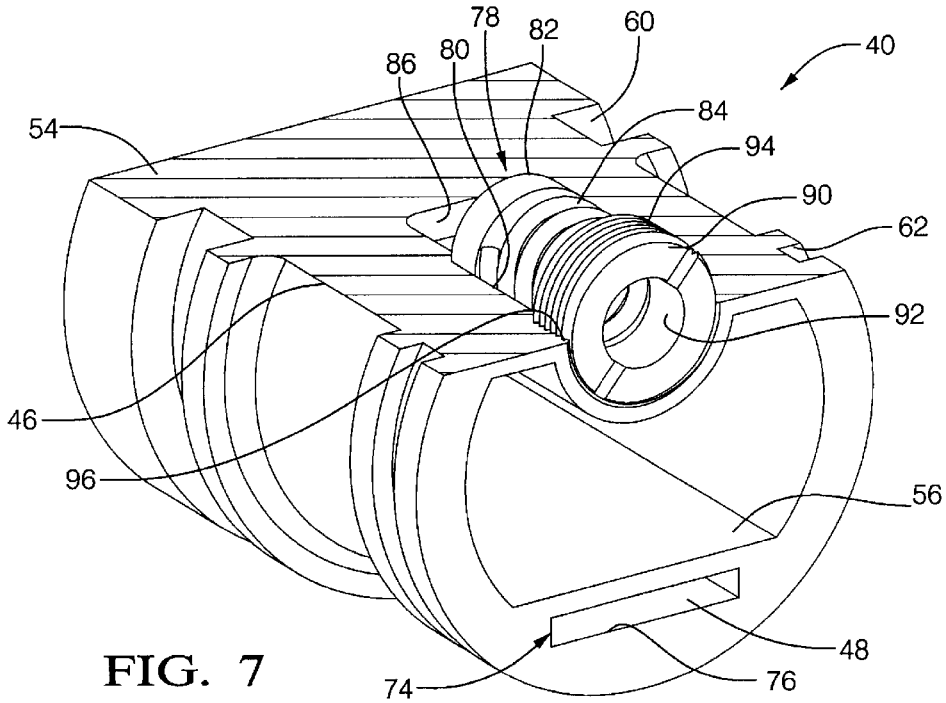

Referring to the drawings, and particularly FIG. 2, a hydraulic flow system 20 is shown having a hydraulic pump 22 driven by motor 24 for delivering a supply of hydraulic fluid to a diverter valve 26 which splits the flow, such that the amount of fluid needed to drive a device, such as the illustrated transmission 28 is passed through the diverter valve onto the transmission 28, and the excess flow is returned through a bypass line 30 back to the pump 22 in a manner to be described below.

The flow of fluid from the transmission 28 is fed to a sump 32 which is then drawn through a filter 34 into an inlet 36 of a primary flow channel 38 of a booster nozzle 40 of the system 20. The flow from the sump 32 represents a primary flow of hydraulic fluid needed to operate a rotating group of the pump 22. The return flow through the bypass line 30 is fed to an inlet 44 of a bypass channel 46 of the booster nozzle 40. The bypass channel 46 is fitted with an appropriate flow restrictor or flow restriction device 48, such as an orifice or jet or other constriction in the flow path of the bypass flow 50. The primary flow of fluid 42 in the primary flow channel 38 is passed on to the inlet of the pump 22. The bypass flow 50 introduced to the bypass channel 46 is fed to the flow restrictor 48 which produces a sudden increase in velocity of the flow 50 at the flow restrictor 48, and a corresponding increase in back pressure in the bypass line 30. The high velocity bypass flow exiting the flow restrictor 48 suddenly decreased in velocity and produces a corresponding increase in pressure of the bypass flow downstream of the flow restrictor 48 where the bypass flow 50 recombines with the primary flow 42 at the intake of the pump 22 to yield a combined flow 52 of hydraulic fluid having an overall increased pressure in volume of flow to the pump 22 then would be provided without the boosting effect of the bypass flow 50 on the primary flow 42.

Turning more particularly to the drawing FIGS. 3–7, it will be seen that the primary flow channel 38 may be preferably located centrally in a nozzle body 54 of the booster nozzle 40 having the inlet 36 at one end and an outlet 56 at the opposite end and being fully isolated along its length from the bypass flow channel 46.

As also shown in these drawings, the nozzle body 54 may preferably have an overall generally cylindrical configuration formed with a set of O-ring grooves 60, 62 which are axially spaced on opposite sides of a reduced diameter section of the nozzle body 54 that serves as the inlet 44 of the bypass channel 46. Suitable O-ring seals 64, 66 are carried in the O-ring grooves 60, 62, respectively, and, as illustrated best in FIG. 5, form a fluid-type seal with a bore 68 of a pump body 70 of the pump 20 associated with the inlet 72 of the pump 22.

The bypass flow 50 from the bypass line 30 is fed through the pump body 70 into the annular inlet 44 of the bypass channel 46, where the bypass flow 50 is initially isolated from the primary flow 42 and sealed against leakage by the O-rings 64, 66. As shown best in FIGS. 3-5, the flow restrictor device 48 may comprise at least one and preferably a plurality of flow restricting jets 74 having outlets 76 adjacent the outlet 56 of the primary flow channel 38. When a plurality of jets 74 are employed, it is preferred that the outlets 76 be arranged in spaced location about the outlet 56 of the primary flow channel 38 to provide a full or partial outer enveloping of the discharge primary flow 42 by the boosted bypass flow 50. It will be appreciated from FIG. 4 that the jets 74 represent a constricted flow passage for the bypass flow 50 as it passes from the bypass channel 46 to the outlet 76 of the jets 74. As the boosted bypass flow 50 exits the outlet 76, it is combined with the primary flow to yield the combined flow 52 of the recombined primary and bypass hydraulic flows at the inlet of the pump 22.

Referring again to FIG. 2 and also to the remaining FIGS. 3–7, the booster nozzle 40 of the invention is fitted with a bypass valve 78. The bypass valve 78 is an open flow communication with the bypass channel 46. The bypass valve 78 is operative to sense the back pressure of the bypass flow 50 in the incoming bypass line 30. In response to the back pressure exceeding a predetermined control pressure, the bypass valve 78 opens an auxiliary bypass flow channel 80 which serves to divert a fraction of the bypass flow 50 fed to the bypass channel 46 around the flow restrictor 48 for direct combination with the delivery of the primary flow 42 at the inlet 72 of the pump 22 so long as the back pressure remains above the control pressure. At a point where the back pressure falls below the control pressure, the bypass valve 78 operates to close the auxiliary flow path, directing all of the bypass flow through the flow restrictor 48.

One embodiment of a suitable bypass valve 78 is illustrated in the drawings, but those skilled in the art will appreciate that other types and configurations of bypass valves could be utilized as an equivalent structure to achieve the same or similar result of bypassing a fraction of the incoming bypass flow around the diverter in the event that the back pressure in the bypass line exceeds a predetermined control pressure.

The illustrated bypass valve 78 includes a seat valve member 82 which is slideably supported in the bypass flow channel 80 and is biased by a spring 84 into seated engagement with a valve seat 86 of the nozzle body 54. When seated, the seat valve member 82 closes the auxiliary bypass flow channel 80. When the back pressure of the incoming bypass flow 50 exceeds the bias force of the spring 84, the back pressure overcomes the spring 84, causes the seat valve member 82 to unseat from the valve seat 86, and compress the spring 84 until such point that the counteracting force of the spring on the seat valve member 82 equals that of the force applied by the back pressure. The seat valve member 82 is formed with at least one and preferably a plurality of fluid openings 88 which are normally blocked and thus closed when the seat valve member 82 is seated against the valve seat 86, but are opened when the seat valve member 82 is unseated to open flow communication between the bypass channel 46 and the auxiliary bypass flow channel 80.

The control pressure of the bypass valve 78 can be adjusted by corresponding adjustment of the closing bias force exerted by the spring 84. As will be appreciated by those skilled in the art, an increase or decrease in the bias force of the spring can be achieved by compressing or decompressing the spring or replacing the spring with another spring having a different spring constant. In the embodiment shown, the bypass valve 78 includes a spring retainer 90 engaging the end of the spring 84 opposite that of the seat valve member 82. The spring retainer 90 includes at least one fluid opening adjacent the outlet 56 of the primary flow 42 for discharging fluid from the auxiliary bypass flow channel 80. As shown, the spring retainer 90 has a single central fluid opening 92 which is preferred, although two or more fluid openings would suffice and are contemplated by the invention.

To accommodate adjustment and/or removal and replacement of the spring 84, the spring retainer 90 is removeably retained and preferably adjustable within the bypass flow channel 80. For this purpose, the spring retainer 90 is formed with screw threads 94 on the outer perimeter which threadably engage screw threads 96 formed in the flow channel 80. This enables the position of the spring retainer 90 to be adjusted within the channel and, if desired, the biasing force exerted on the seat valve member 82 to be adjusted by positioning the spring retainer 90 nearer to or further away from the seat valve member 82 in order to compress or decompress the spring 84, respectively. Such also enables the spring retainer 90 to be removed from the nozzle body 54 in order to remove the spring 84 and replace it with another spring having different spring characteristics to achieve a change in the biasing force and thus control pressure of the bypass valve 78. Accordingly, by exposing the bypass flow 50 upstream of the flow restrictor 48 to the bypass valve 78 of the invention, any back pressure that is built up in the incoming bypass flow due to the presence of a restrictor, is relieved by operation of the bypass valve 78 selectively opening the auxiliary bypass channel 80 to divert a fraction of the flow around the restrictor 48.

The disclosed embodiments are representative of presently preferred forms of the invention, but are intended to be illustrative rather than definitive thereof. The invention is defined in the claims.

What is claimed is:

1. Apparatus for increasing intake pressure of a hydraulic pump, comprising:

a nozzle body;

a primary flow channel formed in said nozzle body having a flow inlet for communicating with a primary flow of hydraulic fluid and a flow outlet for communicating with the inlet of the hydraulic pump for delivering the primary flow of fluid to the pump through the nozzle body;

a bypass flow channel formed in said nozzle body having a flow inlet for communicating with an incoming bypass flow of hydraulic fluid separate from said primary flow, said bypass flow channel including at least one flow restriction device operative to increase the velocity of the bypass flow passing through said flow restriction device for generating a stream of the bypass flow hydraulic fluid with increased pressure at the inlet of the pump adjacent the delivery of the primary flow such that the primary and bypass flows are combined at the pump inlet with an overall increase in pressure of the combined flows; and a bypass valve communicating with said bypass flow channel, said bypass valve being operative to sense back pressure of the incoming bypass flow and, in response to the back pressure exceeding a predetermined control pressure, opening an auxiliary bypass flow channel to divert a fraction of the incoming bypass flow around the flow restriction device for direct combination with the delivery of the primary flow to the inlet of the pump.

2. The apparatus of claim 1 wherein said flow restriction device includes at least one jet.

3. The apparatus of claim 1 wherein said flow restriction device includes a plurality of jets.

4. The apparatus of claim 1 wherein said bypass valve includes a spring biasing said bypass valve to a closed position.

5. The apparatus of claim 4 wherein said bypass valve includes a seat valve member urged by said spring to a closed position against a valve seat and is movable to an unseated position in response to application of a predetermined unseating force exerted by the back pressure to overcome said spring corresponding to said control pressure.

6. The apparatus of claim 5 wherein said seat valve member includes a plurality of fluid openings.

7. The apparatus of claim 4 wherein the unseating force is variable.

8. The apparatus of claim 7 wherein the valve includes a removable spring retainer.

9. The apparatus of claim 8 wherein said spring retainer includes at least one fluid opening.

10. The apparatus of claim 7 wherein the spring is exchangeable with another spring to vary the unseating force of the valve.

11. In a hydraulic flow return system of a transmission pump in which hydraulic fluid discharged from the pump is split into a relatively low pressure low velocity primary return flow which is fed from a sump to an intake booster nozzle adjacent an intake of the pump through a primary flow channel of the intake booster nozzle to supply the pump with the primary flow of hydraulic fluid, and a separate bypass flow which is fed at relatively higher pressure and velocity to the intake booster nozzle through a bypass flow channel having a fixed flow restriction device which boosts the velocity of the bypass flow at the restriction which is then combined with the primary flow downstream of the restriction to increase the overall pressure of the combined primary and bypass flows delivered to the pump; wherein the improvement comprises:

a bypass valve communicating with the bypass flow channel and being operative to sense back pressure of the incoming bypass flow and, in response to the back pressure exceeding a predetermined control pressure, opening an auxiliary bypass flow channel to divert a fraction of the incoming bypass flow around the flow restriction device for direct delivery to the inlet of the pump together with the combined primary and bypass flows delivered through the primary and bypass flow channels.

12. The apparatus of claim 11 wherein said flow restriction device includes at least one jet.

13. The apparatus of claim 11 wherein said flow restriction device includes a plurality of jets.

14. The apparatus of claim 11 wherein said bypass valve includes a spring biasing said bypass valve to a closed position.

15. The apparatus of claim 14 wherein said bypass valve includes a seat valve member urged by said spring to a closed position against a valve seat and is movable to an unseated position in response to application of a predetermined unseating force exerted by the back pressure to overcome said spring corresponding to said control pressure.

16. The apparatus of claim 15 wherein said seat valve member includes a plurality of fluid openings.

17. The apparatus of claim 14 wherein the unseating force is variable.

18. The apparatus of claim 17 wherein the valve includes a removable spring retainer.

19. The apparatus of claim 18 wherein said spring retainer includes at least one fluid opening.

20. The apparatus of claim 17 wherein the spring is exchangeable with another spring to vary the unseating force of the valve.

21. A method for increasing the intake pressure of a hydraulic pump, comprising:

feeding a primary flow of hydraulic fluid to a primary flow channel of a nozzle body for delivery to an intake of the pump;

feeding a separate bypass flow of hydraulic fluid under relatively higher pressure and velocity to a bypass channel of the nozzle body and passing the bypass flow through a flow restriction to cause the bypass flow to increase in velocity at the flow restriction and combining the bypass flow with the primary flow downstream of the flow restriction to provide an overall increase in pressure of the combined flows at the inlet of the pump; and exposing the bypass flow upstream of the flow restriction to a bypass valve which is operative to sense the back pressure of the incoming bypass flow and, in response to the back pressure exceeding a predetermined control pressure, opening an auxiliary bypass flow channel to divert a fraction of the bypass flow around the flow restriction for direct combination with the combined flows at the intake of the pump.

* * * * *